United States Patent [19]

Simion et al.

[11] Patent Number: 4,923,635

[45] Date of Patent: May 8, 1990

[54] LIQUID DETERGENT COMPOSITION CONTAINING ALKYLBENZENE SULFONATE, ALKYL ETHANOL ETHER SULFATE, ALKANOLAMIDE FOAM BOOSTER AND MAGNESIUM AND TRIETHANOLAMMONIUM IONS

[75] Inventors: F. Anthony Simion, Hazlet; Dirk Warscjewski, Spotswood; Leonard A. Zyzyck, Somerset, all of N.J.

[73] Assignee: Colgate-Palmolive Company, Piscataway, N.J.

[21] Appl. No.: 283,034

[22] Filed: Dec. 5, 1988

Related U.S. Application Data

[63] Continuation of Ser. No. 69,679, Jul. 6, 1987, abandoned.

[51] Int. Cl.[5] ..... C11D 1/83; C11D 3/02; C11D 3/30; C11D 11/00

[52] U.S. Cl. ..... 252/545; 252/89.1; 252/133; 252/153; 252/173; 252/544; 252/548; 252/551; 252/553; 252/559; 252/DIG. 14

[58] Field of Search ..... 252/89.1, 153, 173, 252/545, 548, 551, 553, 558, 559, DIG. 5, DIG. 13, DIG. 14, 133

[56] References Cited

U.S. PATENT DOCUMENTS

| | | | |
|---|---|---|---|
| 2,766,212 | 10/1956 | Grifo | 252/152 |
| 2,908,651 | 10/1959 | Grifo | 252/153 |
| 3,998,750 | 12/1976 | Payne | 252/108 |
| 4,056,113 | 11/1977 | Johnson | 134/40 |
| 4,087,518 | 5/1978 | Smith | 424/70 |
| 4,129,515 | 12/1978 | Foster | 252/117 |
| 4,133,779 | 1/1979 | Hellyer | 252/547 |
| 4,235,758 | 11/1980 | Dawson et al. | 252/594 |
| 4,435,317 | 3/1984 | Gerritsen | 252/547 |
| 4,671,894 | 6/1987 | Lamb | 252/545 |
| 4,681,704 | 7/1987 | Bernardino | 252/546 |

*Primary Examiner*—Dennis Albrecht

*Attorney, Agent, or Firm*—Richard J. Ancel; Marta E. Delsignore; Robert C. Sullivan

[57] ABSTRACT

An aqueous light duty liquid detergent composition consisting essentially of, by weight, 10% to 50% of a mixture of a water-soluble alkylbenzene sulfonate detergent salt and a water-soluble alkyl ethenoxy ether sulfate detergent salt in a weight ratio of sulfonate to sulfate in the range of about 0.8:1 to 2:1; about 1% to 8% of an alkanoic acid mono- or di-ethanolamide foam booster; at least about 0.5% to 1.8% of magnesium ions; triethanolammonium ions in an amount to provide a weight ratio of magnesium ion to triethanolammonium ion of 2:1 to 1:2.4; and the balance an aqueous medium, said composition having a pH of 5 to 8 and exhibiting improved oily soil removal and oily solid emulsification properties at a temperature of 18° C. to 26° C. as compared to the same composition without the magnesium and triethanolammonium ions. A method of making said composition comprising the steps of neutralizing alkylbenzene sulfonic acid with magnesium hydroxide to a pH of about 1.5 and thereafter adding sodium hydroxide to increase the pH to the range of 5 to 7, neutralizing the alkyl ethenoxy ether sulfuric acid with a mixture of triethanolamine and ammonium hydroxide, admixing the sulfonate salt with the sulfate salt and thereafter adding said alkanoic acid alkanolamide in liquid form with agitation to form a homogeneous liquid detergent composition. Also described is a method of cleaning articles having oily or greasy soil or a metal or glazed surface comprising contacting said soiled article with water having dissolved therein from 0.5% to 5% by weight of the subject light duty liquid detergent composition.

3 Claims, No Drawings

LIQUID DETERGENT COMPOSITION CONTAINING ALKYLBENZENE SULFONATE, ALKYL ETHANOL ETHER SULFATE, ALKANOLAMIDE FOAM BOOSTER AND MAGNESIUM AND TRIETHANOLAMMONIUM IONS

This application is a continuation of application Ser. No. 069,679, filed July 6, 1987, now abandoned.

FIELD OF THE INVENTION

This invention relates to an aqueous light duty liquid detergent composition containing a mixture of alkylbenzene sulfonate detergent, alkyl ethenoxy ether sulfate detergent and alkanoic acid alkanolamide foam booster which further includes at least about 0.5% by weight of magnesium ions and triethanolammonium ions is a weight ratio of magnesium ion to triethanolammonium ion of about 2:1 to 1:2.4. The invention also includes a method of making the liquid detergent composition comprising the steps of sequentially neutralizing the alkylbenzene sulfonic acid with magnesium hydroxide and sodium hydroxide, neutralizing the alkyl ethenoxy ether sulfuric acid with triethanolamine and ammonium hydroxide and admixing the neutralized salts prior to the addition of the alkanolamide foam booster in liquid form. Further, the invention comprises a method of cleaning articles having soil on a metal or glazed surface which consists essentially of contacting said articles with an aqueous medium containing about 0.5% to about 5% by weight of the inventive liquid detergent composition.

BACKGROUND OF THE INVENTION

In reviewing the performance characteristics of a commercial light duty liquid dishwashing composition—an unbuilt liquid detergent—based upon a mixture of an alkyl benzene sulfonate detergent, an alkyl ethenoxy ether sulfate detergent and an alkanoic acid alkanolamide foam booster, it was noted that this liquid exhibited shortcomings in grease soil removal and in the emulsification of grease soil at temperatures in the range of 18° C. to 26° C.

It has now been discovered that the shortcomings described above can be overcome by including in the described compositions a source of magnesium ions and a source of triethanolammonium ions provided that the weight ratio of magnesium ions to triethanolammonium ions is in the range of about 2:1 to about 1:2.4 and further provided that the concentration of magnesium ions is at least about 0.5% by weight of the liquid detergent composition.

The discovery that the use of controlled proportions of magnesium ion and triethanolammonium ion imparts improved oily soil removal and oily soil emulsification characteristics to the claimed liquid detergent compositions is surprising. More particularly, it was noted that the improvement in oily soil removal and in oily soil emulsification provided by magnesium ion in the absence of triethanolammonium ion tends to diminish at concentrations above at least about 0.5% of magnesium ion in the liquid detergent composition. Further, it was noted that triethanolammonium ions exhibit little or no improvement in oily soil removal or oily soil emulsification in the absence of magnesium ions. Thus, it is considered that the improved grease soil removal and emulsification properties achieved by the joint use of controlled proportions of magnesium ions and triethanolammonium ions clearly is unexpected and suggests that synergism or co-action is present. Furthermore, the proportions are different than the proportions taught in U.S. Pat. No. 4,435,317 which are based on the concentration of $C_{10}$–$C_{16}$ alkyl sulfate.

In further aspects of this invention, it was discovered that optimum proportions for enhanced grease emulsification, particularly at concentrations of magnesium ion in the range of about 0.5% to 1% by weight of magnesium ion is in the range of about 1:2, e.g., about 1:1.4 to about 1:2.4, of magnesium ion to triethanolammonium ion. However, from the standpoint of optimum grease soil removal at 18° C. to 26° C., the optimum ratio of magnesium ion to triethanolammonium ion is about 1:1 at concentrations of magnesium ion in the range of about 1% to 1.8% by weight where the concentration of the liquid detergent composition is about 3% by weight.

PRIOR ART

The use of magnesium ions to provide improved grease soil detergency has been disclosed in the issued patents which follow:

U.S. Pat. No. 2,908,651 teaches that the addition of an inorganic calcium or magnesium salt improved the foaming and detergency properties of liquid detergents containing a higher alkyl benzene sulfonate detergent. The disclosed compositions are single phase liquids.

U.S. Pat. No. 2,766,212 discloses that the addition of the chlorides, sulfates, nitrates, bromides and acetates of magnesium, calcium, aluminum and iron or mixtures thereof improves the foaming and foam stability properties of detergent compositions containing a water-soluble salt of a $C_{10}$–$C_{24}$ alkyl or alkaryl $C_2$–$C_3$ alkoxy ether sulfate as the sole detergent ingredient.

U.S. Pat. No. 4,129,515 discloses homogeneous liquid detergent compositions comprising a mixture of an anionic surfactant and a nonionic surfactant, an alkanolamine and a source of magnesium ions. Preferred compositions contain at least 1%, preferably 3–15% by weight of free (unreacted) alkanolamine. In the exemplified compositions, the ratio of magnesium ion to triethanolammonium ion is less than 1:3. A method of making these compositions also is disclosed comprising admixing anionic sulfuric or sulfonic acid with magnesium hydroxide to a pH of 1 to 5 followed by addition of the alkanolamine to a pH of 6 to 9.

U.S. Pat. No. 4,133,779 discloses liquid detergent compositions for removing grease soil comprising a water soluble semi polar detergent—a tri-alkyl amine oxide or phosphine oxide or a dialkyl sulfoxide—and a magnesium or calcium salt of a detergent selected from a group including alkyl benzene sulfonates, alkyl sulfates, alkyl ethenoxy ether sulfates and mixtures thereof. Optional ingredients include alkali metal or alkanolammonium salts of the specified detergents as well as up to 7% by weight of mono-, di- or tri-ethanolamine. In the exemplified compositions containing both magnesium ion and triethanolammonium ion, the ratio of magnesium ion to triethanolammonium ion is less than 1:3.

U.S. Pat. No. 3,998,750 discloses clear single phase liquid detergent compositions comprising 10% to 40% by weight of a calcium or magnesium salt of an anionic detersive surfactant, 10% to 50% by weight of an ethoxylated nonionic detersive surfactant and 0.1% to 1% by weight of a biphenyl brightener in an aqueous medium. A composition containing 1% by weight of added triethanolamine is stated to be unsatisfactory because the triethanolamine salt of the biphenyl brightener precipitated.

U.S. Pat. No. 4,435,317 discloses physically stable liquid detergent compositions containing a mixture of 4% to 24% by weight of $C_{10}$–$C_{16}$ alkyl sulfate, 0.5% to 20% by weight of $C_{10}$–$C_{16}$ alkyl ethoxy sulfate, 10% to 20% by weight of alkyl benzene sulfonate, 2% to 8% of $C_{10}$–$C_{16}$ mono- or di-$C_2$–$C_3$ alkanolamide suds booster and water which contain magnesium ion in a molar amount corresponding to 0.2–0.7 times the number of moles of alkyl sulfate present. The counter ion or cation for the alkyl sulfate is preferably magnesium and the counter ions for the sulfate and sulfonate detergents may be selected from the group consisting of sodium, potassium, ammonium and alkanolammonium, with ammonium being preferred.

U.S. Pat. No. 3,594,323 and U.S. Pat. No. 4,235,758 each discloses liquid detergent compositions which contain magnesium ions and may contain alkanolammonium salts of anionic detergents.

SUMMARY OF THE INVENTION

In its broadest aspects, this invention relates to a clear, light duty, liquid, detergent composition consisting essentially of about 10% to 50% by weight of a mixture of a water-soluble linear $C_{10}$–$C_{16}$ alkyl benzene sulfonate salt and a water-soluble $C_{10}$–$C_{16}$ primary alkyl ethenoxy ether sulfate salt containing an average of about 1 to 5 ethylene oxide groups per alkyl group, the weight ratio of said alkyl benzene sulfonate salt to said alkyl ether sulfate salt being in the range of about 0.8:1 to 2:1; about 1% to 8% by weight of a $C_8$–$C_{18}$ alkanoic acid mono- or di-ethanolamide foam booster, from at least about 0.5% to 1.8% by weight of magnesium ions, an amount of triethanolammonium ions sufficient to provide a weight ratio of magnesium ions to triethanolammonium ions in the range of about 2:1 to about 1:2.4 and the balance an aqueous medium.

In preferred embodiments of the invention, the weight ratio of alkylbenzene sulfonate salt to alkyl ether sulfate salt will be in the range of about 1:1 to 1.5:1, most preferably 1.05:1 to 1.4:1, the proportion of the alkanoic acid ethanolamide suds booster will be from 1.5% to 7.5%, most preferably 3% to 5%, by weight; the counter ion of the alkyl benzene sulfonate salt will be a mixture of magnesium and sodium, with at least about 80% by weight being magnesium; and the counter ion of the alkyl ether sulfate salt will be selected from the group consisting of triethanolammonium, ammonium, sodium and mixtures thereof, with mixtures containing triethanolammonium ion being most preferred.

DESCRIPTION OF THE INVENTION

The basic detergent composition contains controlled proportions of an anionic detergent—a mixture of an anionic alkylaryl sulfonate detergent and an anionic ethenoxy ether sulfate detergent—and a nonionic $C_8$–$C_{18}$ alkanoic acid ethanolamide foam booster. This basic composition is well known in the patent literature.

The anionic detergent is a mixture of a water-soluble salt of a $C_{10}$–$C_{16}$ alkyl benzene sulfonate salt and a $C_{10}$–$C_{16}$ primary alkyl ethenoxy ether sulfate salt, with the weight ratio of alkyl benzene sulfonate salt to alkyl ether sulfate salt being in the range of 0.8:1 to 2:1, preferably 1:1 to 1.5:1, most preferably about 1.05:1 to 1.4:1.

The water-soluble alkyl benzene sulfonate salt component contains an alkyl group of about 10 to 16 carbon atoms, preferably 10 to 13 carbon atoms with an average of about 11.5 carbon atoms. The alkyl may be either branched chain or linear, with the linear alkyl being preferred. The distribution of phenyl isomers—the point of attachment of the benzene nucleus to the alkyl chain—preferably has a high content of 3, 4, 5 and 6 phenyl isomers and a correspondingly lower content of isomers in which the benzene ring is attached in the 1 or 2 position. Particularly preferred materials are described in U.S. Pat. No. 3,320,174, e.g., an alkyl benzene sulfonate containing about 15% by weight of 2 phenyl isomers and approximately 20% by weight of each of 3, 4, 5 and 6 phenyl isomers wherein the alkyl benzene has a molecular weight of 237 and the following alkyl distribution by weight: $C_{10}$-18%, $C_{11}$-37%, $C_{12}$-41% and $C_{13}$-4%. Such linear alkyl benzenes may be made by either the aluminum trichloride or hydrogen fluoride catalytic processes and the content of cyclic impurities such as dialkyl tetralin may vary from 0% to 15% by weight of the alkyl benzene.

The counter ion of the alkyl benzene sulfonate salt may be sodium, potassium, ammonium, mono-, di- or tri-ethanolammonium or magnesium or a mixture of the foregoing. However, it is preferred that the counter ion be at least 80% magnesium and, in the most preferred compositions, the balance of the counter ion will be sodium.

The second detergent component in the inventive liquid compositions is the water soluble salt of a sulfuric acid ester of the reaction product of one mole of a $C_{10}$–$C_{16}$ alkanol with an average of about one to 5 moles of ethylene oxide. These detergents are well known in the art and are described as alkyl ethenoxy ether sulfates having the following structural formula:

$$R(OC_2H_4)_nOSO_3M$$

wherein R is an alkyl containing from about 10 to about 16 carbon atoms, n has an average value of about one to five and M is a cation or counter ion which is independently selected from the group of counter ions associated with the alkyl benzene sulfonate salt. One preferred sulfate salt has a $C_{12}$–$C_{15}$ alkyl group and contains an average of three moles of ethylene oxide per mole of alkanol. However, corresponding alkyl ethenoxy ether sulfates containing an average of one or two moles of ethylene oxide also are preferred. Since the alkyl ethenoxy ether sulfates are truly blends of individual ethoxylates containing up to 16 or 17 moles of ethylene oxide per mole of alkanol, it should be recognized that such blends can be made by mixing materials having different degrees of ethoxylation, e.g., mixing alkyl ethenoxy ether sulfates having an average of one and an average of three moles of ethylene oxide or, alternatively, mixing an alkyl sulfate with an alkyl triethenoxy ether sulfate. In fact, the performance characteristics of an alkyl monoethenoxy ether sulfate salt are obtained by making a blend of about equal parts of alkyl sulfate and alkyl diethenoxy ether sulfate.

The cation in association with the alkyl ether sulfate is independently selected from the same group of cations that may be in association with the alkyl benzene sulfonate salt. However, in preferred compositions, the cation associated with the alkyl ethenoxy ether sulfate salt will be selected from the group of ammonium, triethanolammonium, sodium and mixtures of the foregoing. Thus, in the preferred compositions the magnesium ion primarily will be associated with the alkyl benzene sulfonate salt and the triethanolammonium ion may be associated with either the alkyl ethenoxy ether sulfate salt or may be derived from added triethanolamine, but most preferably a portion of the triethanolammonium ion will be associated with the alkyl ether sulfate salt.

It should be recognized that the commercial alkyl benzene sulfonate salts and the commercial alkyl ethenoxy ether sulfate salts each often contain small amounts, e.g., 0.5% to 8% by weight in the free acid form, of sulfuric acid or hydrochloric acid depending upon the sulfonating agent employed. More specifically, alkyl benzene may be sulfonated with either sulfur trioxide—to yield a detergent sulfonic acid containing 1-3% by weight of sulfuric acid when sulfur trioxide is the sulfonating agent and up to 8% by weight of sulfuric acid where oleum is the sulfonating agent. Similarly, the concentration of sulfuric acid in the alkyl ethenoxy ether sulfuric acid may range from 0% where chlorosulfonic acid or amidosulfonic acid is employed as a sulfating agent to 1-3% by weight where sulfur trioxide is employed as the sulfating agent or up to 8% by weight where sulfuric acid is employed as the sulfating agent in the commercial process. Small amounts of hydrochloric acid are present, e.g., up to 4% by weight, when chlorosulfonic acid is used as the sulfating agent due to incomplete removal of the hydrogen chloride gas formed in the reaction. Furthermore, small amounts of unreacted alkyl benzene and ethoxylated alkanol also are present in the commercial acid form anionic detergents because the sulfation and sulfonation reactions usually exceed about 97% completion. Thus, small amounts of inorganic sulfates and chlorides of magnesium, triethanolamine and other cations will be present in the inventive liquid detergent compositions.

Generally, the concentration of the mixture of anionic alkyl benzene sulfonate salt and alkyl ethenoxy ether sulfate salt will be about 10% to 50%, preferably 15% to 45%, by weight of the composition, with the ratio of alkyl benzene sulfonate salt to alkyl ether sulfate salt being in the range of 0.8:1 to 2:1, preferably 1:1 to 1.5:1 and most preferably 1.05:1 to 1.4:1 by weight. Since the weight ratio of the two anionic detergents is important, the proportions of the individual ingredients are adjusted to provide the desired concentration of the anionic detergent mixture and the desired weight ratio of sulfonate to sulfate detergent. Thus, the proportion of each of the two individual anionic detergents usually falls within the range of about 5% to 30% by weight based upon the total weight of the liquid detergent composition.

Another essential ingredient in the liquid detergent compositions is a $C_8$–$C_{18}$ alkanoic acid mono- or diethanolamide. This component is widely recognized as a foam booster and satisfactory alkanoic acid ethanolamides include lauric monoethanolamide, myristic monoethanolamide, lauric diethanolamide, myristic diethanolamide and coconut ($C_8$–$C_{18}$) alkanoic acid monoethanolamide and diethanolamide. Preferred alkanoic acid ethanolamides contain 12 to 14 carbons in the fatty acyl group and a particularly preferred compound is lauric-myristic monoethanolamide. The concentration of the foam booster is from 1% to 8%, preferably 1.5% to 7.5% and most preferably 3% to 5%, by weight of the liquid detergent.

At least about 0.5% by weight of magnesium ion is present in the inventive liquid compositions. However, concentrations of magnesium ion up to about 1.8% by weight also may be desirable where optimum soil removal properties are desired. On the other hand, optimal emulsification can be achieved at magnesium concentrations of about 0.5% by weight, with the incremental benefit of magnesium concentrations greater than 0.5% tending to be reduced above that concentration based upon performance evaluations done at a liquid detergent concentration of 1% by weight in water. From a formulation standpoint, the source of the magnesium ions is not critical. For example, magnesium ions may be incorporated in the detergent compositions in the form of water-soluble organic and inorganic magnesium salts such as magnesium chloride, magnesium sulfate, magnesium sulfate heptahydrate, magnesium acetate, magnesium acetate tetrahydrate, magnesium benzoate trihydrate, magnesium nitrate, magnesium nitrate hexahydrate and mixtures of the foregoing. Alternatively, the anionic alkyl benzene sulfonate and the alkyl ethenoxy ether sulfate detergents may be introduced in the form of the magnesium salt by neutralizing a portion of the acid form of either detergent with magnesium hydroxide for example. The first method is advantageous in that the magnesium salt is added to a composition made using conventional ingredients and a conventional method of manufacture. However, the latter method is preferred because it does not result in the introduction of added sulfate or chloride ions which usually raise the clear/cloud temperature of the liquid detergent composition in the absence of additional solubilizers. Most preferably, a major portion of the magnesium ion is introduced as the cation of the alkyl benzene sulfonate salt as well as the cation of any salts resulting from by-product sulfuric acid or hydrochloric acid present in the acid form detergent.

The essential triethanolammonium ion can be incorporated in the liquid detergent compositions by the addition of triethanolamine or as the cation of the anionic alkyl benzene sulfonate salt or of the alkyl polyethenoxy ether sulfate salt. Triethanolamine is a standard item of commerce which is produced by the reaction of ethylene oxide with ammonia. As with the magnesium ion, it is preferred that the triethanolammonium ion be introduced in part as the cation of an anionic surfactant, most preferably as the cation of the alkyl ethenoxy ether sulfate salt. However, the presence of free triethanolamine as a source of the triethanolammonium ion also is satisfactory. The proportion of the triethanolamine should be sufficient to yield a magnesium ion to triethanolammonium ion weight ratio in the range of about 2:1 to about 1:2.4. As stated heretofore, a magnesium to triethanolammonium ion weight ratio of about 1:1 is optimal for soil removal at 18° C. to 26° C.; whereas, a weight ratio of about 1:2 is optimal for oily soil emulsification at both 18° C. to 26° C. and at 40° C. to about 47° C.

It should be noted that the weight ratio of magnesium ion to triethanolammonium ion also is affected by the weight ratio of alkyl benzene sulfonate salt (ABS) to alkyl ethenoxy ether sulfate salt (AEOS) and, therefore, this ratio must be integrated with the ratio of detergents. For example, the higher ratios of magnesium to triethanolammonium are less effective than lower ratios thereof in improving the soil removal properties when the weight ratio of ABS to AEOS is about 2:1, whereas, said higher ratio is more effective in improving soil removal propertes at a weight ratio of ABS to AEOS of about 1.05:1. Furthermore, the optimal ratio of magnesium to triethanolammonium ion appears to be different for grease soil removal than for grease soil emulsification, with the lower ratio being more effective for grease soil emulsification effects. From a practical standpoint, however, it is desirable to use the highest ratio of magnesium ion to triethanolammonium ion because such a ratio results in a lower cost due to the addition of a smaller proportion of triethanolamine or the corresponding triethanolammonium ion.

Usually, the balance of the liquid composition will be an aqueous medium comprising water and about 0% to 15%, preferably 2% to 10%, by weight (based upon the weight of the liquid detergent composition) of a solubilizer selected from the group consisting of $C_2$–$C_3$ monohydric and polyhydric alcohols, water-soluble $C_1$–$C_3$ alkyl substituted benzene sulfonates, urea and mixtures thereof. Suitable monohydric alcohols are ethanol and isopropanol, with ethanol being preferred; and suitable polyhydric alcohols include propylene glycol and glycerol. Suitable $C_1$–$C_3$ alkylbenzene sulfonates are sodium, potassium and ammonium salts, e.g., sodium xylene sulfonate, potassium toluene sulfonate and sodium isopropylbenzene or cumene sulfonate. Typically, the solubilizer is selected to provide clarity and/or a low-temperature cloud point and/or to control viscosity. Since the alcohol and sulfonate solubilizers do not exhibit the same effects, usually the liquid compositions herein will contain a mixture of alcohol and hydrotropic sulfonate solubilizers. Furthermore, urea may be included as a solubilizer where the desired low-temperature cloud temperature or viscosity cannot be achieved in its absence. The proportion of water will be in the range of about 25% to about 88%, preferably about 36% to about 80.5%, by weight of the liquid detergent composition.

The described liquid compositions are essentially unbuilt liquids, i.e., do not contain proportions of organic or inorganic builder salt in the detergent building proportions, and, therefore, are particularly suitable for use as liquid, hand dishwashing detergents. Thus, these inventive compositions can contain any of the usual adjuvants found in those compositions provided that they do not interfere with the performance properties of the inventive liquids. Such additional ingredients include minor proportions of perfumes and colors for aesthetic purposes, opacifiers such as ethylene glycol distearate or polystyrene, thickening agents such as natural gums or hydroxypropyl methyl cellulose, sequestering agents such as citrate or ethylene diamine tetraacetate, preservatives such as formaldehyde or Dowicil® 200 or monomethyloldimethyl hydantoin, and inert salts such as sodium sulfate. The total concentration of added ingredients usually will be less than 5%, preferably less than 3%, by weight of the total composition.

Generally, the viscosity of the liquid compositions will be variable over the range of about 20 centipoises (cps) to 2000 cps., and preferably from 75 cps. to 1500 cps. Viscosity is measured using a Brookfield Viscometer, Model LVF, with a #1 spindle rotating at 12 r.p.m. (The #1 spindle covers the viscosity range of 0–500 cps. and higher numbered spindles are employed for liquids of higher viscosity, e.g., #2 spindle covers the range of 500–2500 cps.) The most preferred viscosity range is 150 cps. to 1200 cps. based upon current consumer preferences. However, it will be recognized by one skilled in the art that liquids of even higher viscosity can be achieved by including up to 2% by weight of a known thickening agent in the inventive compositions.

Generally, these liquid compositions are prepared by admixing the individual detergent ingredients with the formula weight of water with agitation at a temperature in the range of about 24° C. to 65° C. Usually, the individual detergents are added in the form of aqueous solutions or dispersions of the anionic detergent salts. Typically, the alkanoic acid alkanolamide is added in liquid form as one of the last ingredients at a temperature below about 55° C. Additionally, it is desirable to add any solubilizing agent to the formula weight of water prior to the addition of the essential anionic detergent ingredients in order to avoid formation of gels. Any additional ingredients, such as color and perfume usually are added with agitation after the alkanolamide while cooling the mixture to a temperature of 25° C. to 32° C. The pH is usually adjusted, if necessary, to a pH in the range of 5–8, preferably 6.5–7.5, for dishwashing products by addition, for example, of either sulfuric acid or citric acid or sodium hydroxide, potassium hydroxide or triethanolamine. Further, any adjustment of viscosity may be achieved by adding additional amounts of the appropriate solubilizers or thickening agents.

In the manufacture of the preferred compositions, the method of making includes the steps of neutralizing a $C_{10}$–$C_{16}$ linear alkyl benzene sulfonic acid with magnesium hydroxide to a pH of about 1.5 and thereafter adding sodium hydroxide to increase the pH to the range of 5 to 7, neutralizing a $C_{10}$–$C_{16}$ alkyl ethenoxy ether sulfuric acid with a mixture of triethanolamine and ammonium hydroxide, admixing said sulfonate salt with said sulfate salt and thereafter adding said alkanoic acid ethanolamide in liquid form with agitation to form a homogeneous liquid detergent composition. Furthermore, where a solubilizer is present in the liquid detergent, desirably the mixture of said sulfonate salt and said sulfate is prepared in the presence of a solubilizer selected from the group consisting of $C_2$–$C_3$ alcohols, $C_1$–$C_3$ alkyl-substituted benzene sulfonates, urea and mixtures thereof.

When the inventive liquid detergent compositions are prepared, for example, by adding a magnesium organic or inorganic salt and triethanolamine to a liquid detergent composition which contains the mixture of anionic detergents and the alkanolamide foam booster, it is preferred that the amine be added prior to the source of magnesium ions in order to produce a clear solution.

The grease emulsification characteristics of the inventive liquid compositions are illustrated using an Emulsion Stability Test wherein twenty (20) grams of the test solution of the test compositon at the test temperature are filled into a thirty milliliter vial (2.5 cm.×9.5 cm.) and 0.2 grams of corn oil soil is added to the vial. A stopper is inserted into the vial and the vial is rotated through an arc of 180° twenty five times at an approximate rate of one rotation per second. The vial then is permitted to stand at rest for a period of five minutes, with readings being taken using either (a) a Hack Model 2100 Turbidimeter or (b) a Brinkman PC 800 Colorimeter with a one centimeter light probe and a 490 nm filter after one, three and five minutes. The results are then regressed based upon the predicted readings for three minutes. Higher turbidity values indicate more stable emulsions and lower colorimetry values indicate more stable emulsions.

Based upon the foregoing analysis of a 1.0% weight concentration of the inventive compositions, the Emulsion Stability Test values based on turbidity values for a liquid detergent composition containing, by weight, 17% of sodium linear $C_{10}$–$C_{13}$ alkyl benzene sulfonate, 13% by weight of ammonium $C_{12}$–$C_{15}$ alkyl triethenoxy ether sulfate and 4% by weight of lauric-myristic monoethanolamide at varying product concentrations of magnesium ion and triethanolammonium ion are set forth in Tables I–IV below:

TABLE I

| Conc of $Mg^{++}$ | Conc of $TEA^{+}$ | Predicted Emulsion Stability Value After 3' at 21° C. |
|---|---|---|
| 0 | 0 | 12 |
| .1 | 0 | 32 |
| .2 | 0 | 49 |
| .3 | 0 | 62 |
| .4 | 0 | 72 |
| .5 | 0 | 78 |

TABLE II

| Conc of $TEA^{+}$ | Conc of $Mg^{++}$ | Predicted Emulsion Stability Value After 3' at 21° C. |
|---|---|---|
| 0 | 0 | 12 |
| 0.1 | 0 | 9 |
| 0.2 | 0 | 6 |
| 0.5 | 0 | 3 |
| 0.7 | 0 | 5 |
| 0.9 | 0 | 10 |
| 1.0 | 0 | 14 |

TABLE III

| Conc of $Mg^{++}$ | Conc of $TEA^{+}$ | Predicted Emulsion Stability Value After 3' at 21° C. |
|---|---|---|
| 0 | 0 | 12 |
| 0.1 | 0.2 | 27 |
| 0.2 | 0.4 | 43 |
| 0.2 | 0.5 | 43 |
| 0.25 | 0.5 | 51 |
| 0.3 | 0.6 | 59 |
| 0.4 | 0.8 | 77 |
| 0.4 | 1.0 | 86 |
| 0.5 | 1.0 | 95 |

TABLE IV

| Conc of $Mg^{++}$ | Conc of $TEA+$ | Predicted Emulsion Stability Value After 3' at 21° C. |
|---|---|---|
| 0.4 | 0.2 | 69 |
| 0.4 | 0.4 | 68 |
| 0.4 | 0.6 | 71 |
| 0.4 | 0.7 | 73 |
| 0.4 | 0.8 | 77 |
| 0.5 | 0.2 | 75 |
| 0.5 | 0.4 | 75 |
| 0.5 | 0.6 | 79 |
| 0.5 | 0.7 | 82 |
| 0.5 | 0.9 | 90 |
| 0.5 | 1.0 | 95 |
| 0.6 | 1.2 | 114 |

Table I shows that addition of magnesium ions to the test composition results in an improvement in emulsion stability, with stability being greatest at 0.5% concentration of magnesium ion. Further, the results show that the incremental improvement in stability for each 0.1% by weight of magnesium ion diminishes above the initial 0.1% concentration of magnesium ion. More specifically, addition of 0.1% by weight of magnesium ion increases emulsion stability by 20 units—a 166% increase—whereas the increase in magnesium ion concentration from 0.4% to 0.5% by weight increases emulsion stability by 6 units—a 6.5% increase. Table II shows that the addition of triethanolammonium ion to the test composition does not improve emulsion stability at triethanolammonium ion concentrations in the range of 0 to 1% by weight and, in fact, has an adverse effect on stability in the 0–0.9% weight concentration range. However, Tables III and IV clearly show that the addition of magnesium ion and triethanolammonium ion in a weight ratio of about 1:2 results in an unexpected improvement in emulsion stability at magnesium concentrations of at least about 0.5% by weight, with an emulsion stability value of 95 being obtained at a weight concentration of 0.5% magnesium ion and 1.0% triethanolammonium ion as compared to a value of 78 for the same composition containing 0.5% by weight of magnesium ion and no triethanolammonium ion or a value of 14 for the same composition containing 1% by weight of triethanolammonium ion and no magnesium ion. Furthermore, Table IV points out that emulsion stability is particularly enhanced at magnesium ion to triethanolammonium weight ratios of 1:1.4 and below. Clearly, such improvement in emulsion stability is surprising. Additionally, similar enhanced emulsion stability is shown at 40° C. in the same test.

When the foregoing compositions are evaluated for soil removal using the Cup Method wherein 0.5 grams of lard is coated on the side of a 250 ml beaker between the bottom and the 150 ml mark and then contacted with 250 ml of a stirred concentration of the test composition in water for five minutes, with the degree of removal being based upon the transmission reading using the Brinkman PC 800 colormeter with a one centimeter probe and a 490 nm filter, the soil removal results are similar to the emulsion stability results. For example, incremental soil removal of magnesium disappears at about 0.5% by weight of magnesium ion and triethanolammonium ion does not remove soil at a concentration of 0–1% by weight. In addition, concentrations 0.5% and 0.6% by weight of magnesium and 1% and 1.2% by weight of triethanolamine result in enhanced soil removal.

Soil removal characteristics of the liquid detergent compositions of this invention also are determined using a static screen soak test. In this test a wire mesh screen (16 mesh) measuring one inch by one inch which is covered with hamburger grease which has been dyed red with 0.08% Sudan Red dye is suspended in 100 milliliters of a test concentration of the liquid detergent composition being tested at the test temperature and the rate at which the hamburger grease is emulsified off is qualitatively assessed using the following scale:

0: No emulsification observed
1: Emulsification rate equal to a good commercial light duty liquid
2: Emulsification rate intermediate the good commercial liquid and a good laboratory liquid composition
3: Emulsification rate equal to said laboratory liquid
4: Emulsification rate superior to said laboratory liquid.

Table V sets forth the soil removal results that are obtained when a 3% weight concentration of a liquid detergent composition containing 17% by weight of sodium linear dodecylbenzene sulfonate, 13% by weight of ammonium $C_{12}$–$C_{15}$ alkyl triethenoxy ether sulfate, 4% by weight of lauric-myristic monoethanolamide, 4.3% by weight of ethanol, 2.4% by weight of sodium xylene sulfonate, 0.9% by weight of sodium cumene sulfonate, varying proportions of magnesium sulfate heptahydrate, varying proportions of triethanolamine and the balance water is tested using this soil removal test.

TABLE V

| Product Conc. of $Mg^{++}$ | Product Conc. of $TEA^{+}$ | Weight Ratio of $Mg^{++}/TEA+$ | Soil Removal Value |
|---|---|---|---|
| .10 | 0 | — | 0 |
| .43 | 0 | — | 0.33 |
| .43 | .33 | 1.3:1 | 1 |
| .43 | .99 | 1:2.3 | 1 |
| 1.1 | 0 | — | 0.66 |
| 1.1 | 1.0 | 1.1:1 | 2 |
| 1.1 | 1.67 | 1:1.5 | 2 |
| 1.77 | 1.0 | 1.8:1 | 2 |
| 1.77 | 1.67 | 1.06:1 | 2.67 |
| 1.77 | 3.35 | 1:1.8 | 2.0 |
| 1.77 | 4.17 | 1:2.4 | 1.67 |

Table V shows that the optimum ratio of magnesium ion to triethanolammonium ion for soil removal in this test is about 1:1 for liquid detergent compositions containing from 1% to 1.77% by weight of magnesium ion. Furthermore, Table V shows that optimum soil removal is achieved with an inventive liquid detergent composition containing 1.77% by weight of magnesium ion and 1.67% by weight of triethanolammonium ion at a concentration of 3% by weight of the liquid detergent composition in water.

Specific inventive liquid compositions are illustrated by the following examples. All quantities indicated in the examples or elsewhere in the specification are by weight unless otherwise indicated.

EXAMPLE 1

A preferred liquid detergent according to the present invention has the following composition:

| | % by weight |
|---|---|
| Magnesium linear dodecyl benzene sulfonate | 19.4 |
| Sodium linear dodecyl benzene sulfonate | 1.3 |
| Ammonium $C_{12}$–$C_{15}$ alkyl triethenoxy ether sulfate | 18.0 |
| Lauric-myristic monoethanolamide | 4.0 |
| Triethanolamine | 1.2 |
| Sodium xylene sulfonate | 2.4 |
| Sodium cumene sulfonate | 0.7 |
| Ethanol | 4.3 |
| Color, perfume | q.s. |
| Water | bal. |
| | 100.0 |

This composition is prepared by neutralizing a $C_{10}$–$C_{13}$ linear alkyl benzene sulfonic acid—contains 97% by weight of said sulfonic acid and 0.9% by weight of sulfuric acid—with aqueous magnesium hydroxide to pH of about 1.5 and the neutralization is completed with 49% aqueous sodium hydroxide to pH 6. 30.77 parts by weight of an aqueous mixture containing 58% by weight of ammonium $C_{12}$–$C_{15}$ alkyl triethenoxy ether sulfate and 14% by weight of ethanol are mixed with 43.6 parts by weight of the aqueous $C_{10}$–$C_{13}$ alkyl benzene sulfonate at a temperature of about 24° C. 10 parts by weight of an aqueous mixture containing 40% by weight of lauric myristic monoethanolamide and 24% by weight of sodium xylene sulfonate is added to the aqueous mixture of sulfonate and sulfate detergents with agitation to form a homogeneous liquid at a temperature of about 35° C. Thereafter, 1.5 parts by weight of an aqueous sodium cumene sulfonate (45% by weight), 1.2 parts by weight of triethanolamine, 0.2 parts by weight of aqueous hydroxyethyl ethylene diamine tetraacetic acid, trisodium salt (41.5% by weight), color and perfume are added in sequence with agitation. The pH is adjusted with sodium hydroxide to 7.3 and a clear liquid detergent composition having a specific gravity of about 1.05 is obtained. The cloud point of the liquid is below 13° C. and its viscosity is 450±50 cps at 25° C. as measured by a Brookfield RV Viscometer using a #1 spindle rotating at 20 rpm.

When the grease soil removal properties of this liquid which contains 0.73% by weight of magnesium ions and has a magnesium ion to triethanolammonium ion weight ratio of 1:1.6 are determined using the Cup Method at about 24° C., the results set forth in Table VI are obtained. The results for an effective commercial light duty liquid detergent composition containing an amine oxide foam booster (Commercial A) and another commercial liquid detergent composition containing 17% by weight of sodium linear $C_{10}$–$C_{13}$ alkyl benzene sulfonate, 13% by weight of ammonium $C_{12}$–$C_{15}$ alkyl triethenoxy ether sulfate and 4% by weight of lauric-myristic diethanolamide (Commercial B) are included for purposes of comparison.

TABLE VI

| Product | Transmission at 490 nm 1' | 3' | 5' |
|---|---|---|---|
| Exampie 1 | 56 | 22 | 11 |
| Commercial A | 64 | 30 | 16 |
| Commercial B | 100 | 100 | 100 |

These results indicate that the composition of Example 1 is superior to the two commercial liquids in grease soil removal. Furthermore, this superiority is confirmed in the Baumgartner soil removal test wherein lard soil is removed from frosted glass slides which are dipped into and out of the test detergent solution at a specific rate.

In addition to exhibiting good grease removal properties at 18° C. to 26° C., the composition of Example 1 is superior to commercial products—Commercial A and Commercial B—in initial foam height in a standard foam test.

EXAMPLE 2

Another liquid detergent composition according to the invention has the following composition:

| Ingredient | % by weight |
|---|---|
| Magnesium linear dodecylbenzene sulfonate | 21.6 |
| Sodium linear dodecylbenzene sulfonate | 2.4 |
| Sodium $C_{12}$–$C_{14}$ alkyl diethenoxy ether sulfate[a] | 5.0 |
| Triethanolamine lauryl sulfate[a] | 6.0 |
| Coconut diethanolamide | 1.5 |
| Ethanol | 3.0 |
| Urea | 1.5 |
| Formalin (37% formaldehyde) | 0.30 |
| Perfume | 0.4 |
| Green color (1.3% soln.) | 0.3 |
| Water, salt | q.s. |
| | 100.0 |

(a) Mixture is approximately equivalent to an alkyl ethenoxy ether sulfate having an average of about 0.8 moles of ethylene oxide per mole of alkanol.

This composition is a clear liquid detergent at 25° C. having a pH of 6.6 and a specific gravity of 1.06±0.01. It has a cloud point of 10° C. maximum and a viscosity of 200 seconds as measured by a Raymond #2 flow tube. Except for the step of adding the triethanolamine lauryl sulfate, this composition is prepared by the same process employed in Example 1 above. The liquid detergent contains 0.91% by weight of magnesium ions and about 2.16% by weight of triethanolammonium ions and has a magnesium to triethanolammonium ion weight ratio of about 1:2.4.

EXAMPLE 3

Another liquid detergent composition according to this invention follows:

| Ingredient | % by weight |
|---|---|
| Magnesium linear dodecylbenzene sulfonate | 15.9 |
| Sodium linear dodecylbenzene sulfonate | 1.1 |
| Ammonium $C_{12}$–$C_{15}$ alkyl triethenoxy ether sulfate | 13 |
| Lauric-myristic monoethanolamide | 4 |
| Ethanol | 4.3 |
| Sodium xylene sulfonate | 2.4 |
| Sodium cumene sulfonate | 0.9 |
| Triethanolamine | |
| Green color | q.s. |
| Perfume | q.s. |
| Water, salts | q.s. |
| | 100.0 |

This composition is a clear liquid having a pH of 7.3 and a viscosity of 250 cps. The ratio of ABS to AEOS is 1.3:1 and the weight ratio of magnesium ion to triethanolammonium ion is about 1:2.1, with the concentration of magnesium ion being 0.57% by weight. This composition also is prepared by the process employed in Example 1.

EXAMPLE 4

Another satisfactory liquid detergent composition according to this invention follows:

| Ingredient | % by weight |
|---|---|
| Magnesium linear dodecylbenzene sulfonate | 15 |
| Sodium linear dodecylbenzene sulfonate | 1 |
| Ammonium $C_{12}$–$C_{15}$ alkyl triethenoxy ether sulfate | 14 |
| Lauric-myristic monoethanolamide | 4 |
| Ethanol | 4.3 |
| Sodium xylene sulfonate | 2.4 |
| Sodium cumene sulfonate | 0.9 |
| Triethanolamine | 1.2 |
| Green color | q.s. |
| Perfume | q.s. |
| Water, salts | q.s. |
| | 100.0 |

This composition is prepared by the process employed in Example 1 and the resultant clear liquid detergent composition has a viscosity of 250 cps. The ratio of ABS salt to AEOS salt is 1.14:1 and the weight ratio of magnesium ion to triethanolammonium ion is 1:22, with the concentration of magnesium ion being 0.54% by weight.

As indicated, the inventive liquid detergent compositions are effective in removing grease soil from soiled articles having metal or glazed surfaces. Thus, a further aspect of the invention relates to a method of cleaning articles having an oily or grease soil on a metal or glazed surface which consists essentially of contacting the soiled article with water having dissolved therein from 0.5% to 5% by weight of a liquid detergent composition consisting essentially of about 10% to 50% by weight of a mixture of a water-soluble $C_{10}$–$C_{16}$ alkyl benzene sulfonate salt and a water-soluble $C_{10}$–$C_{16}$ primary alkyl ethenoxy ether sulfate salt containing an average of about 1 to 5 ethylene oxide groups per alkyl group, the weight ratio of said alkyl benzene sulfonate salt to said alkyl ether sulfate salt being in the range about 0.8:1 to 2:1; about 1% to 8% by weight of a $C_8$–$C_{18}$ alkanoic acid mono- or di-ethanolamide foam booster, at least about 0.5% to 1.8% by weight of magnesium ions, an amount of triethanolammonium ions sufficient to provide a weight ratio of magnesium ions to triethanolammonium ions in the range of about 2:1 to about 1:2.4 and the balance an aqueous medium, at a temperature in the range of 18° C. to 50° C. This method is particularly effective where the temperature of the washing medium is in the range of 18° C. to 26° C. Preferably, the concentration of the dissolved liquid detergent will be in the range of 1% to 3% by weight and will be a preferred composition.

What is claimed is:

1. A method of making a liquid detergent composition consisting essentially of about 10% to 50% by weight of a mixture of a water-soluble $C_{10}$–$C_{16}$ alkyl benzene sulfonate salt and a water-soluble $C_{10}$–$C_{16}$ primary alkyl ethenoxy ether sulfate salt containing an average of about 1 to 5 ethylene oxide groups per alkyl group, the weight ratio of said alkyl benzene sulfonate salt to said alkyl ether sulfate salt being in the range about 1:1 to 1.5:1; about 1% to 8% by weight of a $C_8$–$C_{18}$ alkanoic acid mono- or di-ethanolamide foam booster, at least about 0.5% to 1.8% by weight of magnesium ions, an amount of triethanolammonium ions sufficient to provide a synergistic weight ratio of magnesium ions to triethanolammonium ions in the range of about 1:1 to about 1:2.4 and the balance an aqueous medium comprising water and about 0% to 15% by weight of a solubilizer selected from the group consisting of $C_2$–$C_3$ monohydric and polyhydric alcohols, water-soluble $C_1$–$C_3$ alkyl substituted benzene sulfonates, urea and mixtures thereof, said composition having a pH of from 5 to 8 and exhibiting improved oily soil removal and oily soil emulsification properties at a temperature of 18° C. to 26° C. as compared to the same composition without the magnesium ions and triethanolammonium ions, comprising the steps of neutralizing a $C_{10}$–$C_{16}$ linear alkyl benzene sulfonic acid with magnesium hydroxide to a pH of about 1.5 and thereafter adding sodium hydroxide to increase the pH to the range of 5 to 7, neutralizing a $C_{10}$–$C_{16}$ alkyl ethenoxy ether sulfuric acid with a mixture of triethanolamine and ammonium hydroxide, admixing said sulfonate salt with said sulfate salt and thereafter adding said alkanoic acid ethanolamide in liquid form with agitation to form a homogeneous liquid detergent composition.

2. A method according to claim 1 wherein the mixture of said sulfonate salt and said sulfate is prepared in the presence of 2% to 10% of said solubilizer and a clear liquid detergent composition is formed.

3. A method of making the liquid detergent composition consisting essentially of about 10% to 50% by weight of a mixture of a water-soluble $C_{10}$–$C_{16}$ alkyl benzene sulfonate salt and a water-soluble $C_{10}$–$C_{16}$ primary alkyl ethenozy ether sulfate salt containing an average of about 1 to 5 ethylkene oxide groups per alkyl group, the weight ratio of said alkyl benzene sulfonate salt to said alkyl ether sulfate salt being in the range about 1:1 to 1.5:1; about 1% to 8% by weight of a $C_8$–$C_{18}$ alkanoic acid mono- or di-ethanolamide foam, booster, at least about 0.5% to 1.8% by weight of magnesium ions, an amount of triethanolammonium ions sufficient to provide a synergistic weight ratio of magnesium ions to triethanolammonium ions in the range of about 1:1 to about 1:2.4 and the balance an aqueous medium comprising water and about 0% to 15% by weight of a solubilizer selected from the group consisting of $C_2$–$C_3$ monohydric and polyhydric alcohols, water-soluble $C_1$–$C_3$ alkyl substituted benzene sulfonates, urea and mixtures thereof, said composition having a pH of from 5 to 8 and exhibiting improved oily soil removal and oily soil emulsification properties at a temperature of 18° C. to 26° C. as compared to the same composition without the magnesium ions and triethanolammonium ions, comprising the steps of admixing triethanolamine with an aqueous composition containing a sodium or ammonium salt of said sulfonate, a sodium or ammonium salt of said sulfate and said alkanoic acid alkanolamide, thereafter admixing a water-soluble magnesium salt selected from the group consisting of magnesium sulfate, magnesium sulfate heptahydrate, magnesium acetate, magnesium acetate tetrahydrate, magnesium benzoate trihydrate, magnesium chloride, magnesium chloride hexahydrate, magnesium nitrate, magnesium nitrate hexahydrate, and mixtures thereof with the mixture of the preceding step and adjusting the pH of the resultant composition to a pH of from 6.5 to 7.5.

* * * * *

UNITED STATES PATENT AND TRADEMARK OFFICE

CERTIFICATE OF CORRECTION

PATENT NO. : 4,923,635

DATED : May 8, 1990

INVENTOR(S) : F. Anthony Simion, Dirk Warschewski, Leonard A. Zyzyck

It is certified that error appears in the above-identified patent and that said Letters Patent is hereby corrected as shown below:

On the title page, item "[75] Inventors: F. Anthony Simion, Hazlet; Dirk Warscjewski, Spotswood; Leonard A. Zyzyck, Somerset, all of N.J." should read -- F. Anthony Simion, Hazlet; Dirk Warschewski, Spotswood; Leonard A. Zyzyck, Somerset, all of N.J.--

Signed and Sealed this

Seventeenth Day of March, 1992

*Attest:*

HARRY F. MANBECK, JR.

*Attesting Officer*

*Commissioner of Patents and Trademarks*